US008590459B2

(12) United States Patent
Forclaz et al.

(10) Patent No.: US 8,590,459 B2
(45) Date of Patent: Nov. 26, 2013

(54) BOGIE FOR VARIABLE RAIL GAUGE AND CHANGING STATION OF THE RAIL GAUGE

(75) Inventors: Jean-Marc Forclaz, Glion (CH); Cedric Giller, La Tour de Peliz (CH)

(73) Assignee: Compagnie du Chemin de fer Montreux-Oberland Bernois SA, Montreux (CH)

( * ) Notice: Subject to any disclaimer, the term of this patent is extended or adjusted under 35 U.S.C. 154(b) by 111 days.

(21) Appl. No.: 12/867,530

(22) PCT Filed: Feb. 5, 2009

(86) PCT No.: PCT/EP2009/051307

§ 371 (c)(1),
(2), (4) Date: Aug. 13, 2010

(87) PCT Pub. No.: WO2009/101023

PCT Pub. Date: Aug. 2, 2009

(65) Prior Publication Data

US 2010/0319564 A1 Dec. 23, 2010

(30) Foreign Application Priority Data

Feb. 13, 2008 (CH) ..... 0203/08

(51) Int. Cl.
*B61F 7/00* (2006.01)

(52) U.S. Cl.
USPC ..... 105/178; 104/33

(58) Field of Classification Search
USPC ..... 104/32.1, 33; 105/178
See application file for complete search history.

(56) References Cited

U.S. PATENT DOCUMENTS 5,421,265 A * 6/1995 Sugimoto et al. ..... 104/33
5,471,933 A * 12/1995 Yoshino et al. ..... 104/33

FOREIGN PATENT DOCUMENTS

EP 0 193 919 A 9/1986
EP 0 594 040 A 4/1994
FR 2 874 883 A 3/2006

OTHER PUBLICATIONS

International Search Report and Written Opinion; International Application No. PCT/EP2009/051307; International Filing Date: Feb. 5, 2009.
International Preliminary Report on Patentability and Written Opinion; Application No. PCT/EP2009/051307; mailed Aug. 27, 2010; 7 pages.

* cited by examiner

*Primary Examiner* — Zachary Kuhfuss
(74) *Attorney, Agent, or Firm* — Antonelli, Terry, Stout & Kraus, LLP.

(57) ABSTRACT

The bogie of variable rail gauge comprises two lateral carrier mountings (1;2) with two wheels (1', 1", 2', 2") independent of each others, which lean one against the other, forming between them an articulation (3) allowing a variation of the rail bogie in sliding between the traverses forming part of the two lateral carrier mountings (1;2), entirely, allowing anytime a relative rotation or tipping, respectively, between the traverses (2;3) in the vertical planes of the wheels.

8 Claims, 4 Drawing Sheets

BOGIE FOR VARIABLE RAIL GAUGE AND CHANGING STATION OF THE RAIL GAUGE

RELATED APPLICATION

This is a U.S. national phase application of International Application No. PCT/EP2009/051307 filed Feb. 5, 2009 with claiming priority of Switzerland Application No. 203/08 filed Feb. 13, 2008.

TECHNICAL FIELD

The present invention relates to a bogie for variable rail gauge for vehicles on rails, comprising two lateral carrier mountings each having two wheels independent from each other, these lateral carrier mountings leaning mutually against each other with the aid of traverses adjustable in relative position allowing a variation of the rail gauge of the two lateral carrier mountings, every desired position can be blocked with a locking mechanism; a principal traverse leaning on the two lateral carrier mountings via an intermediate of a first suspension and provided for supporting the cabin of a vehicle via an intermediate of a second suspension, as well as a changing station of the rail gauge of such a bogie.

BACKGROUND AND SUMMARY

Vehicles on rails having bogies for variable rail gauge are known, which in view of their complexity and costs are not suitable for putting into operation for railway rails in tourist areas where often railway networks for standard rail and metric rails are found. Also some known constructions are utilizable for changing a standard rail gauge into a larger rail gauge, leaving enough space for constructive solutions which could not be implemented on bogies of a narrow rail gauge (as for example for metric rails). For some networks, there is no other choice than the quite unpleasant procedure of changing the train for passing from a standard railway network to a narrower railway network.

Thus, the object of the present invention is to allow compositions for narrow rail gauges (hereafter referred to as metric rail) pulled by a locomotive provided for running on a network of a wider rail gauge (hereafter referred to as standard rail) to travel on the wider rail gauge network only by changing the motor driven vehicle (assuming the locomotive has no bogies for variable rail gauges for technical or economical reasons). Thus, the passengers avoid changing trains.

The interface between the vehicles for metric rail and the motor driven vehicle for standard rail, be it buffers, coupling, cables of control and transfer of energy, can be arranged in 2 possible variations:

A. Motor driven vehicles for standard rail are equipped with standard coupling devices for metric rail.

B. Head and end vehicles of the train for metric rail are equipped with standard coupling devices for standard rail.

In principle, it is possible to provide even motor driven vehicles with bogies according to the present invention (not recommended by reasons of economy).

At least the wagons are equipped with bogies for variable rail gauge. The changing of the rail gauge is made on a specific arrangement disposed at the exit of the network for metric rails, if possible in a stopping railway station for carrying out the changing of the motor driven vehicle during a regular stop. Only the bogies for variable rail gauge are taken-over by the arrangement for changing the rail gauge. All the other bogies, carrier mountings or motors can circulate on the arrangement for transship without being influenced.

Thus, it is likewise an object of the present invention to provide a changing station of the rail gauge for bogies according to the present invention.

In order to achieve the first object of the present invention, the invention provides constructive means wherein mutual support between the traverses of the lateral carrier mountings is implemented on each side with the aid of an articulation allowing a variation of the rail gauge by sliding between the traverses and anytime, also in the blocked position of the rail gauge, a rotation relative between the traverses or lateral carrier mountings, respectively, in the vertical planes of the wheels.

Other particular embodiments are defined as described hereinafter.

An arrangement for changing the rail gauge of a bogie according to the present invention is also disclosed as described hereinafter.

The station for changing the rail gauge of a bogie of variable rail gauge for vehicles on the rails is characterized in that a rail of a first rail gauge is given; a rail of a second rail gauge is given, the rails being mounted one into the other; the inside rail being interrupted between the ends at in determined length in order to allow the wheels of the bogie to pass at the variation of the rail gauge from one gauge into the other rail gauge; the soil in the changing zone of the rail gauge, at least in the part of the inside rail interrupted, being formed between the rails by a metal plate; the guides of changing of the rail gauge, provided for receiving the guiding elements connected to the locking mechanism of the bogie in order to make passing the lateral carrier mountings from one rail gauge into the other during the advancement of the vehicle; and outside guiding rails, outside of the template of the vehicles, for receiving the folding down lifting arms and thus, assuring the progressive elevation of the principal traverse and of the locking mechanism during the phase of changing of the rail gauge, all the elements and pieces of the station of the changing of the rail gauge being fixed. This changing station allows compositions for standard rail gauge to be adapted for running on metric rail gauge and vice versa.

BRIEF DESCRIPTION OF DRAWINGS

Hereafter, the invention will be described in a more detailed manner with the aid of embodiments shown in the figures, wherein is shown in.

Figure 1:
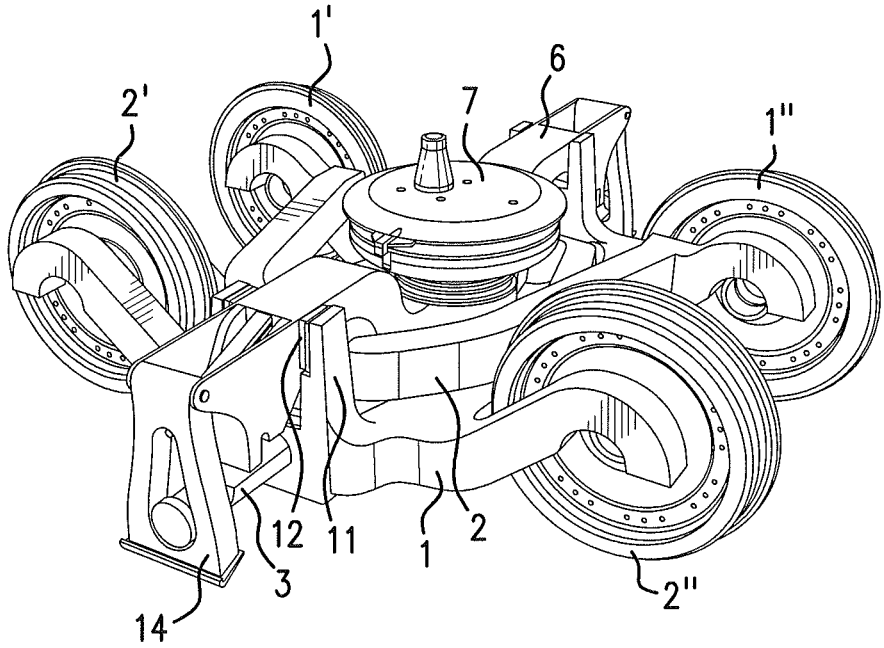
FIG. 1 in perspective view and only schematically, a bogie according to the present invention.
Figure 2:
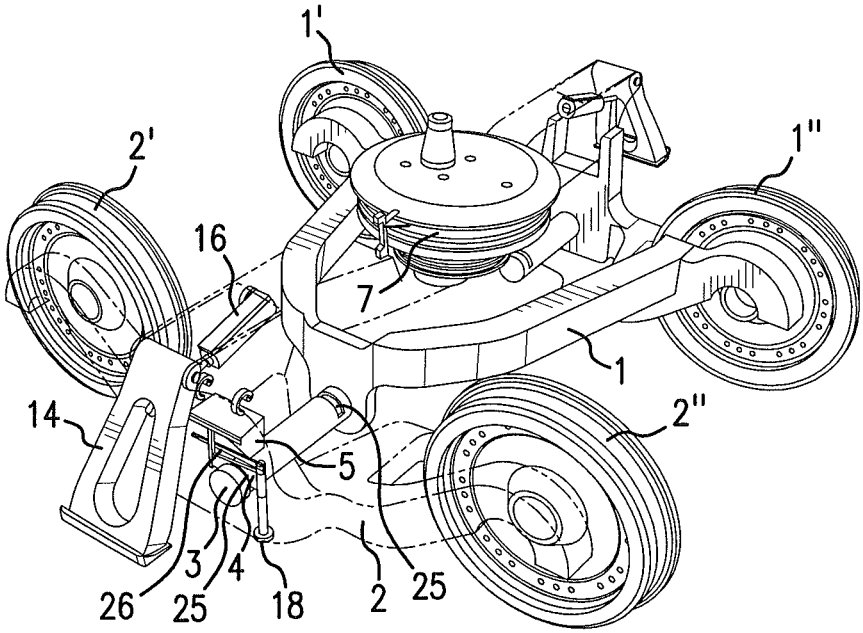
FIGS. 2 to 5 details of the present invention, in particular, bogies in different positions (different rail gauges; locked and non-locked positions)
Figure 3:
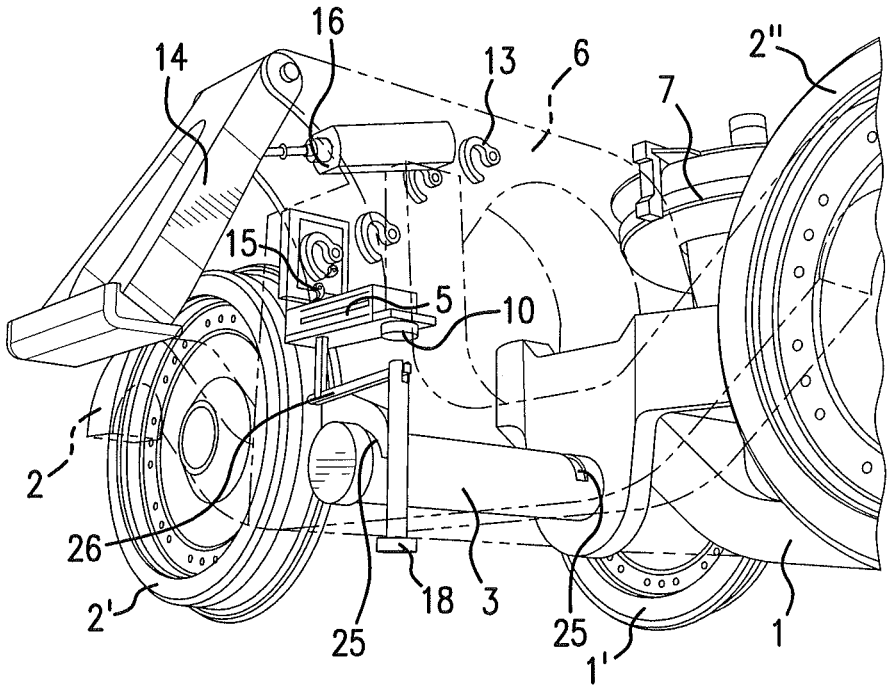
Figure 4:
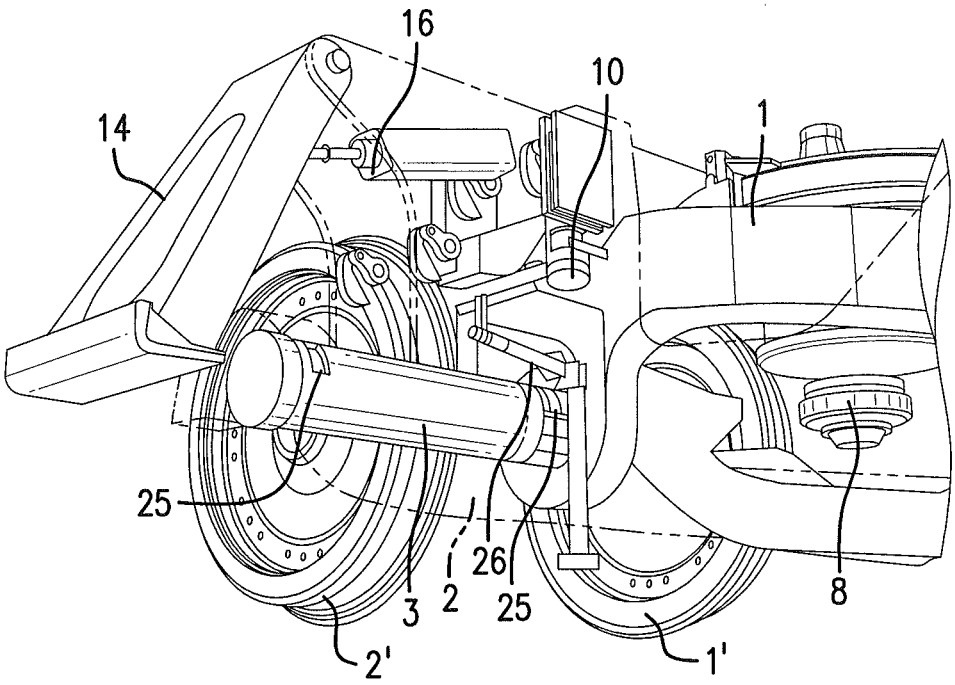
Figure 5:
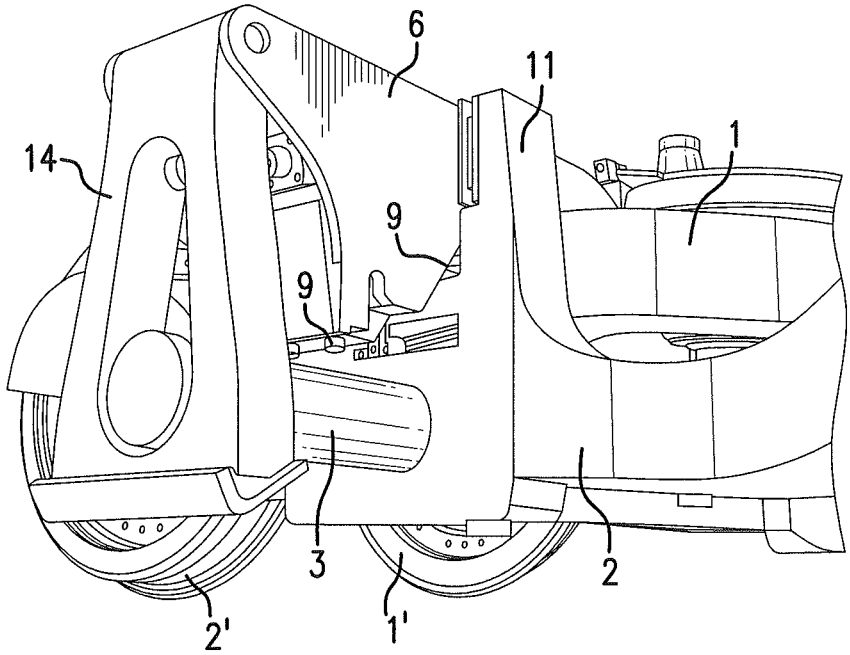

The FIGS. 1 to 5 of the drawings show the principle of the construction of the bogie for variable rail gauges according to the present invention.

DETAILED DESCRIPTION

The bogie comprises two lateral carrier mountings, also referred to as semi-chassis 1,2, in this case, one right and one left, each equipped with two independent wheels 1', 1" and 2', 2" being jointed and leaning mutually against each other in their centre with the aid of a construction (hereafter referred to as articulation 3 allowing a variation of the rail gauge by sliding between the traverses and anytime, also in the blocked position of the rail gauge, a rotation relative between the traverses or the two semi-chassis 1,2, respectively, in the vertical planes of the wheels. The articulation 3 between the lateral carrier mountings 1,2 is implemented at each side by a cylindrical element forming the free end of each carrier mounting and traversing a bore into a cheek of the opposite carrier mounting, with the axis of the two cylindrical elements being situated on the same axis geometric. The articulations allow a rotation of a respective semi-chassis in relation to the other in order to guarantee the contact of each of the 4 wheels 1', 1", 2', 2" to the rail, independently of a possible distortion of the rails. The articulation of each semi-chassis to the other chassis is equipped with a locking device 4 of the articulation allowing the blocking of the two semi-chassis 1,2, in the distance correspondent to the desired rail gauges. This relative rotation of a semi-chassis in relation to the other replaces the function of the first suspension of the bogies of the traditional arrangement.

Each semi-chassis 1,2, serves as support to a first suspension 5 on which a transversal frame is supported (hereafter referred to as principal traverse 6). This traverse 6 supports the second pneumatic central suspension 7 linking the traverse 6 to the cabin of a vehicle, an anti-pitching device also as all damping and/or stabilizing systems between the bogie and the cabin. The transmission of the longitudinal and transverse loadings between the cabin (not-shown) and the traverse 6 is assured for example via a pivot 8 (FIG. 4) integrated in the second suspension, fixed to the case, whose lower-lying section is situated in the traverse 6 and transmits the loadings via the intermediate of the chaoutchouc supports. Vertically, the pivot 8 is free in relation to the traverse 6 in order to allow the pneumatic second suspension to work.

For each of the rail gauges to choose, the traverse 6 disposes of a support and guiding device (hereafter referred to as support 9 of the traverse) originated from being situated in the first suspension. The support can be of a different height for the metric rail (narrow rail gauge) and the standard rail (wide rail gauge) in order to compensate the variations of the height of the platform. The first suspensions assure the transmission of the vertical, longitudinal and transversal loadings with their respective suspension properties. The first suspensions are mounted on a spring device (hereafter referred to as unlocking springs 10) serving as unlocking mechanism via a vertical movement according to the principle hereafter described as "changing of the rail gauge".

Each semi-chassis 1,2 is equipped with a guiding device of the traverse 11 serving for longitudinal transmission of the loadings between the traverse 6 and the semi-chassis 1,2 exclusively during the phase of changing of the rail gauge. In order to achieve this, the traverse is inserted between the guiding plates 12 fixed to each of the semi-chassis 1,2. These plates 12 comprise a chaoutchouc articulation allowing a relative rotation of the traverse 6 in relation to the semi-chassis while the whole line circulation and the transmission without impact of the feeding or the braking force during the phase of changing of the rail gauge.

Running Position:

For one as for the other of the rail gauges, the whole weight of the traverse 6 and of the vehicle, presses on the first suspensions which themselves compress the unlocking springs 10. Thus, the articulation 3 and as a consequence, the rail gauge are locked. Furthermore, the traverse 6 is assured in this running position on the first suspension with the aid of a device (referred to as locking traverse-chassis 13, mechanically connected to the lifting arms 14) blocking the journals 15, of the guiding device of the traverse 11 whose function is described hereafter. The locking mechanism for each side comprises at least two straddled cavities 25 on the cylindrical element, the position of each corresponding to one of the rail gauges being selectable and a bar 26 connected to the lateral carrier mounting via a system of springs adjacent to this bar engages into the cavity corresponding to the chosen rail gauge in standard running position under influence of the springs and blocks the rail gauge in this position but being removable temporarily from the cavity in order to allow a variation of the rail gauge. This locking excludes all inopportune vertical moving of the traverse 6 and as a consequence, the whole risk of changing of the rail gauge during running. The bar of the mechanism of the locking is connected to a guiding element, in unlocked position, in order to adjust the bar and change the rail gauge.

During the Changing of the Rail Gauge:

Means are provided to allow lifting of the principal traverse, and also in case of the case of the vehicle, in relation to the lateral carrier mountings and for controlling the locking mechanism of the locking in view to release the locking of the rail gauge, i.e. the traverse 6 is equipped at each side with a lifting arm device 14, which can be optionally controlled by a cylinder 16 pneumatic, hydraulic or electric according to the instructions of the mechanic. The positions of resting and of spreading of the lifting arm 14 are controlled by electric safety contacts.

The principal traverse shows folding down lifting arms at two ends, for example with the aid of lifters. The lifting arms serve for assuring the locking between the principal traverse and the lateral carrier mountings. In the resting position these lifting arms 14 remain in the template of the vehicle. In the changing position of the rail gauge, the lifting arms 14 spread on both sides of the traverse 6 outside the template of the vehicle and are taken over by guiding rails 17 of the station of changing of the rail gauge, see below.

The deployment of the lifting arm 14 provokes in a first time, mechanically, the liberation of the locking of the traverse-chassis 13. Subsequently, the guiding rails 17 take over the traverse 6, which lift that way progressively.

The first suspension, pushed upstairs by the unlocking springs 10, follows this movement and releases the locking of the articulation 3. The vertical movement of the first suspension is mechanically coupled to the descent of guiding snugs 18 of the changing of the rail gauge. These guiding snugs 18 engage into changing guides 19 of the rail gauge, which during the advancement of the vehicle make passage of the two semi-chassis 1,2 from one rail gauge into the other rail gauge.

During this phase, the transmission of the longitudinal loadings of driving or braking between the traverse 6 and the semi-chassis 1,2 is assured via the guiding plates 12.

Figure 6:
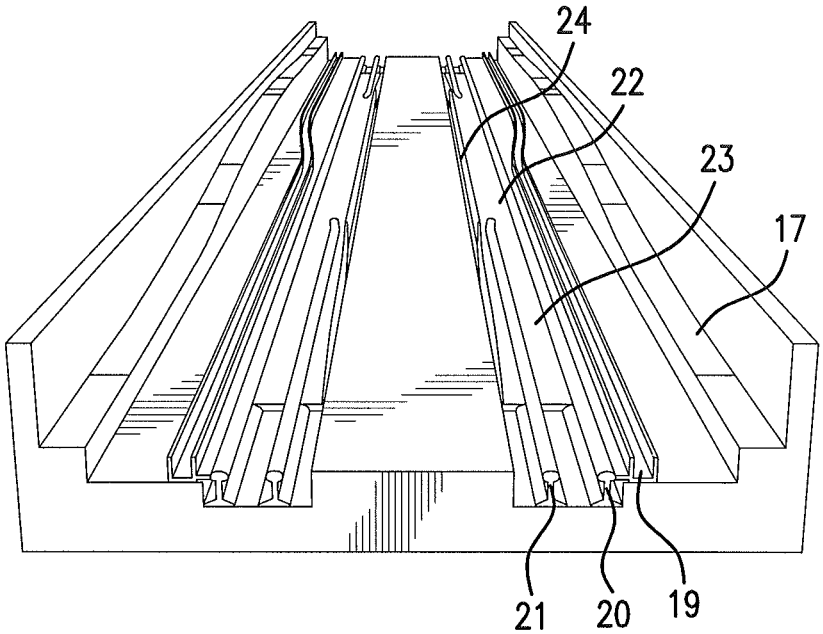
FIG. 6 a perspective view of a changing station of the rail gauge.
Figure 7:
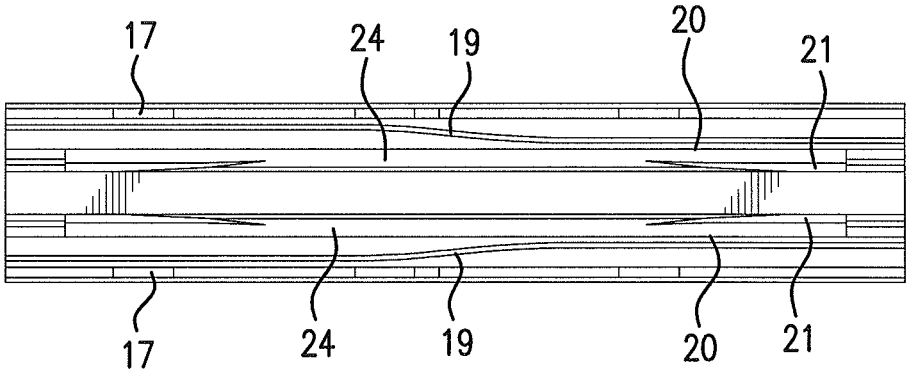
FIG. 7 a plain view of the station according to FIG. 6.
Figure 8:
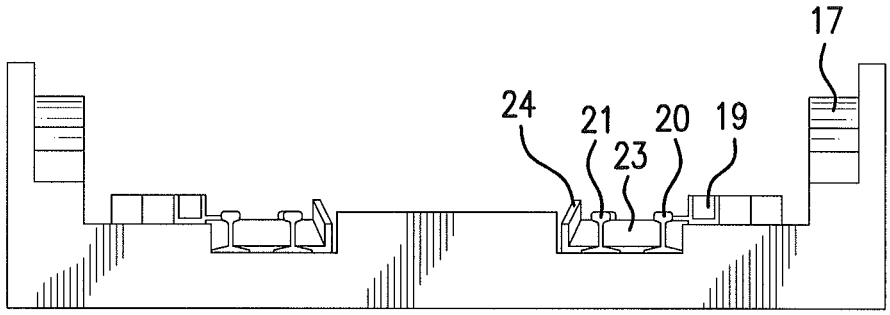
FIG. 8 a station of FIGS. 6 and 7 in a cross-sectional view.

The Construction of the Station of Changing of the Rail Gauge will be Described Hereafter (see FIGS. 5 to 8):

The station is conceived suitable to allow the passage of the vehicles for standard rail 20 or for metric rail 21 with or without changing of the rail gauge in the same way. It is not equipped with any mobile part.

The rolling is executed on the wheel flanges in the whole zone of changing of the rail gauge. The rolling is executed on a metal plate, e.g. a steel plate 22 situated underneath of the plane of the rail in a depth slightly lower than the minimum height of the wheel flanges in operation on the two rail gauges. On both sides of this zone, inclined planes 23 assure a soft passage of the rolling on the rail in rolling onto the flange.

Outside of the standard rail 20, guides 19 of changing of the rail gauge are disposed in order to take over the guiding snugs 18 of which only the bogies for variable rail gauge are equipped with. Thus, only the bogies of which the guiding snugs 18 (hereafter) have been activated will change the rail gauge.

At the very outside, outside of the template of the vehicles, the guiding rails 17, assuring the progressive elevation, the supporting and the guiding of the vehicle during the phase of changing of the rail gauge.

Passage to the Station of a Bogie with Changing of the Rail Gauge:

The composition of the vehicles on the rails pulled by a locomotive for metric rail hits the arrangement of changing of the rail gauge in reduced velocity, head or end locomotive. Only the bogies for variable rail gauge equipped with guiding snugs 18 will have an interaction with the arrangement.

Before the station of changing of the rail gauge, the mechanics give a "changing of the rail gauge order", all the bogies of variable rail gauge receive this order. On both sides, the lifting arms 14 of each bogie spread themselves. The correct position of this device is controlled, the mechanic receives a quittance of it. If a lifting arm 14 is not in correct position the convoy is stopped.

The bogies for variable rail gauge enter into the arrangement or the station. The guiding rails 17 of the "guiding support" disposed on both sides of the vehicle, outside of the template of the locomotive in order to not hinder its passage, take over the lifting arms 14. These inclined guiding rails 17, in the vertical plane, elevate progressively, adjust the height and guide laterally the traverse 6 during the whole phase of changing of the rail gauge. The process of changing of the rail gauge in the bogie occurs according to the description hereafter.

At the exit of the station, the guiding rails 17 descend again progressively, the traverse 6 positions itself on the first suspensions via the intermediate of the other support of the traverse, the unlocking springs 10 of the first suspension compress themselves, which locks the articulations 3 and lifts the guiding snugs 18 into resting position.

When all the bogies have run over the arrangement or the station of the transfer, an order of "locking of the rail gauge is declared", the lifting arms 14 regain their resting position and the locking of the traverse-chassis 13 is assured.

Passage on the Station of a Vehicle without Changing of the Rail Gauge:

If necessary, the arrangement of the station allows the passage of the vehicles for standard rail by rolling on the flanges and a transversal guiding by the rails.

In the zone of changing of the rail gauge, the rails for standard rail are interrupted. The vehicles for metric rail are guided in transversal manner by the opposite rails 24 disposed on the faces inside of the wheels.

The guiding rails 17 of the station of transfer are disposed in order to leave the passage free to the vehicles, the widest suitable for running over the station.

All types of vehicles are adaptable for transiting onto the ramp, only the bogies specific of which the lifting arms 14 have been spread and as a consequence, the descended guiding snugs 18 will enter in interaction with the ramp.

General Remarks:

The principle of the independent wheels allows the braking devices and other auxiliary devices fixed to the semi-chassis to follow the changing of the rail gauge.

The elements caoutchouc absorbing the propagation of the vibrations can be provided between the housing of the axis of the wheels and the chassis. Disc or shoe brakes are conceivable.

Each wheel must be equipped with an individual antigliss system.

In principal, the concept allows also an individual motorization by wheel or common for the two wheels of each of the chassis of the semi-chassis. Thus, the mechanics can be mounted on the semi-chassis or underneath the case of the vehicle with a cardan transmission connecting the case to the bogie.

The concept described above for the metric rail and the standard rail applies analogously for other combinations of rail gauges.

In principal, a variation of rack rail is conceivable. A support of the wheel of the rack rail, its brake device, even a motor of traction or a cardan gearbox, can be fixed on one of the semi-chassis. A device for picking-up forces, fixed on the face of the other semi-chassis will engage into the support of the wheel of the rack rail for the rail gauge the most narrow in order to distribute the brake loadings of the rack rail to the two chassis in symmetric manner.

The invention claimed is:

1. A bogie for variable rail gauge for vehicles on rails, comprising two lateral carrier mountings each equipped with two independent wheels arranged in a vertical plane, these lateral carrier mountings lean mutually against each other by way of articulations of the lateral carrier mountings adjustable in relative position allowing a variation of the rail gauge of the two lateral carrier mountings, positions of the articulations corresponding to respective, desired rail gauges can be blocked in blocked positions by a locking mechanism;

a principal traverse of the bogie leaning on the two lateral carrier mountings by way of an intermediate first suspension and provided for supporting the cabin of a vehicle by way of an intermediate second suspension, wherein mutual support between the lateral carrier mountings is such that the lateral carrier mountings are joined in a center of the mountings by the articulations allowing a variation of the rail gauge by sliding between the articulation and the corresponding lateral carrier mounting and wherein the mutual support allows, in a blocked position of the articulation corresponding to a desired rail gauge, a relative rotation between the articulation and the lateral carrier mounting within a vertical plane of the wheels, wherein the vertical plane delimits the rotational radius of the relative movement.

2. A bogie according claim 1, wherein the articulation is implemented at each side by a cylindrical element forming a free end of the articulation of each carrier mounting and traversing a bore into a cheek of the opposite carrier mounting, axes of the two cylindrical elements being coaxial.

3. A bogie according to claim 2, wherein the locking mechanism for each side comprises at least two spaced cavities on the cylindrical element, the position of each corresponding to a selectable rail gauge, and a bar connected to the lateral carrier mounting via a system of springs adjacent to this bar engages the cavity corresponding to the chosen rail gauge in standard running position under influence of the springs and blocks the rail gauge in this position but being removable temporarily from the cavity in order to allow a variation of the rail gauge.

4. A bogie according to claim 3, further comprising means for cooperating with a rail gauge charging station for lifting the principal traverse in relation to the lateral carrier mountings and for controlling the locking mechanism to release the blocking by the locking mechanism to permit changing the rail gauge.

5. A bogie according to claim 3, wherein the bar of the locking mechanism is connected to a guiding element, in an unlocked position, in order to adjust the bar and change the rail gauge.

6. A bogie according to claim 1, wherein the principal traverse is attached to lifting arms at each end, which are foldable with the use of lifters.

7. A bogie according to claim 6, wherein the lifting arms assure locking between the principal traverse and the lateral carrier mountings.

8. A station for changing the rail gauge of a bogie of variable rail gauge for vehicles on the rails, the station comprising:

a first pair of rails of a first rail gauge;

a second pair of rails of a second rail gauge, the second pair of rails being mounted inside of the first pair of rails;

the second pair of rails being interrupted between the ends at a determined length in order to allow the wheels of the bogie to pass at the variation of the rail gauge from one of the first and second rail gauges into the other;

wherein in a changing zone for changing the rail gauge of a bogie in the station, at least in a part where the inside, second pair of rails is interrupted, a metal plate is situated beneath the rails;

changing guides for changing of the rail gauge, provided for receiving guiding elements connected to a locking mechanism of a bogie in order to make passing lateral carrier mountings of a bogie change from one of the first and second rail gauges into the other during the advancement of a vehicle; and outside guiding rails located outside of the changing guides and vehicles advanced on the station, for receiving folding down lifting arms on a bogie and thus, assuring the progressive elevation of a principal traverse and of a locking mechanism of a bogie during changing of the rail gauge, all the elements and pieces of the station for changing the rail gauge being fixed.

* * * * *